United States Patent [19]

Wilson

[11] 3,953,099

[45] Apr. 27, 1976

[54] ONE-PIECE ENVIRONMENTAL REMOVABLE CONTACT CONNECTOR

[75] Inventor: William Dean Wilson, Naperville, Ill.

[73] Assignee: Bunker Ramo Corporation, Oak Brook, Ill.

[22] Filed: June 2, 1975

[21] Appl. No.: 583,233

Related U.S. Application Data

[63] Continuation of Ser. No. 423,035, Dec. 10, 1973, abandoned, which is a continuation of Ser. No. 275,751, July 27, 1972, abandoned.

[52] U.S. Cl. ..... 339/60 M; 339/113 R; 339/117 R; 339/126 RS; 339/184 M

[51] Int. Cl.[2] ..... H01R 13/52; H01R 13/64

[58] Field of Search ..... 339/59–62, 339/91, 94, 112, 113 R, 117, 176 M, 184, 186, 217 RS, 126

[56] References Cited

UNITED STATES PATENTS

| | | | |
|---|---|---|---|
| 2,782,391 | 2/1957 | Kirk | 339/60 R |
| 2,809,361 | 10/1957 | Woofter et al. | 339/59 M |
| 3,184,701 | 5/1965 | Ellis | 339/59 M |
| 3,199,060 | 8/1965 | Marasco | 339/60 R |
| 3,255,427 | 6/1966 | Yeiser | 339/59 R |
| 3,321,733 | 5/1967 | Thomas | 339/94 R |
| 3,336,569 | 8/1967 | Nava | 339/94 M |
| 3,452,321 | 6/1969 | Carissimi et al. | 339/176 M |
| 3,683,315 | 8/1972 | Kelly | 339/61 R |

*Primary Examiner*—Joseph H. McGlynn
*Attorney, Agent, or Firm*—D. R. Bair; F. M. Arbuckle

[57] ABSTRACT

An environmental electrical connector is provided in which the receptacle and plug members are individually formed as one-piece housings of resilient insulating material, having contact cavities formed with frontwardly disposed contact-retaining shoulders and rearwardly disposed resilient risers providing sealing engagement against lead-in conductors, with a sleeve at the mating end of the receptacle having an elastically expandable circumferential lip, and a complementary surface on the plug being provided for sealing engagement with the receptacle lip, as the front seal. A molded shape inside the sleeve and a matching cutaway portion on the plug prevent mating otherwise than in properly polarized relation, and matching longitudinal grooves on the outside of the connector members serve as visual alignment aids.

8 Claims, 7 Drawing Figures

ONE-PIECE ENVIRONMENTAL REMOVABLE CONTACT CONNECTOR

This is a continuation of application Ser. No. 423,035, filed Dec. 10, 1973 now abandoned; which was a continuation of Ser. No. 275,751, filed July 27, 1972, now abandoned.

BACKGROUND OF THE INVENTION

This invention relates to environmental connectors providing an environmental seal for a plurality of mated electrical contacts and their connections to rearwardly disposed conductors extending externally from the connectors. More particularly, the invention relates to circular connectors formed of mated receptacle and plug members which individually provide rear seals for individual conductor-contact combinations and when mated, provide front seals for environmental protection of the contacts against moisture and other ambient conditions.

In the past, these connectors have been of a variety of constructions, depending on the requirements and performance associated with their use. In one type, the receptacle and plug members are individually constructed of a plurality of insulating and housing parts in addition to the contacts. Where rear removal of the contacts and connected conductors are desired, the connector members often include a rear resilient grommet, which in some instances is formed by a multiplicity of resilient risers, and one or more frontwardly disposed dielectric inserts for retaining the contacts and for forming the front seal by abutting engagement with a corresponding front insert or inserts on the mating member. Various retaining means including retaining rings are also present to retain the various parts together in the metallic housing and to form the desired construction.

While these connectors have many advantages, they require a multiplicity of parts, are often relatively expensive to manufacture, and require a number of manufacturing and assembly operations. In addition, these connectors usually require a coupling ring or other means to move the front inserts together to form the front seal.

While other types of these connectors have been produced, they have not always provided front and rear seals with removable contacts in a less complex construction and simplified manufacture. Therefore, it is desirable that new environmental connectors be provided and include front and rear sealing features while permitting rearward removal of the contacts.

SUMMARY

Briefly, this invention is directed to an environmental connector formed of circular receptacle and plug members which individually provide front and rear seals and permit rear removal of contacts. Each connector member is construction with a one-piece molded housing of resilient insulating material such as synthetic rubber and includes features which act to provide both rear and front seals when the members are mated, with the rear seals also permitting rear removal of the contacts. In both the front and rear seals, the mating parts are sized to provide an interference fit. In the rear seal formed against an individual conductor, the housing has a cavity rearwardly sized slightly smaller than the conductor with the adjoining portion of the housing being sufficiently resilient to permit insertion of the contact and to bear against the conductor in a sealing relation. In the front seal formed around the mating contacts, the receptacle and plug are mated by telescoping action with an inner mating section of the receptacle sized slightly smaller than the complementary portion of the plug to provide a sealing relation. The housing is molded with a cavity or cavities around each of which rearwardly is formed a resilient riser, or a plurality of resilient risers longitudinally spaced apart to provide a restricted passage in each cavity. As a rear seal, these risers form the portion of the housing around the passage which is sufficiently resilient to permit insertion of a conductor and to contract about the conductor in a sealing relation. Frontwardly in each cavity are provided contact retention means for retaining the contact from removal by normal contact coupling and uncoupling forces while permitting contact removal rearwardly by a larger rearwardly directed force.

The one piece insulating housing for the receptacle member also includes a thin inwardly directed cylindrically shaped, resilient front sleeve providing an interference fit against the plug during telescoping engagement. The sleeve includes a section having an inner dimension such as to provide a seal by a resilient interference fit with a cooperating seal surface on the plug. In one embodiment the section has an inwardly directed elastically expandable, sealing lip extending circumferentially around the inner front end portion of the sleeve. The one-piece insulating housing of the plug member includes a front portion with a cylindrically shaped outer perimeter for telescoping engagement with the sleeve and as a lip-receiving portion a rearwardly disposed circumferential groove for sealing engagement with the lip of the receptacle member at the final stage of mating.

During mating of the members, the section of the sleeve providing the seal in the final stages of telescoping engagement bears against a sleeve engagement portion of the plug which is sized slightly larger than the adjoining sleeve section to form a tight interference fit. In the above identified embodiment the radially expandable lip on the sleeve of the receptacle member rides over the cylindrically-shaped outer perimeter of the plug member and then snaps into the rearwardly disposed groove which constitutes a cooperative sealing surface. This connection holds the members together in a sealing relationship without requiring any additional coupling parts inasmuch as the engagement of the lip against an abutting shoulder of the groove provides a detent action, retaining the plug and receptacle in mated relation against an axial separating force less than the normal unmating force.

In addition, with the insulating housing for each member being of a one-piece construction, the unmating of the members normally develops a small vacuum between the separating front faces of the members which advantageously limits the adverse effects of a sudden shock or momentary rearwardly directed forces on the connector.

The connector construction of the invention provides a number of advantages. The connector is of relatively low cost and involves relatively few manufacturing and assembly operations. In addition, contacts can be crimped to external conductors and then mounted in the bores of the cavities and thereafter the contacts individually can be rearwardly removed for servicing and replacement. Also, the resilient nature of the insulating material for the housing permits the use of front and rear abutment shoulders which are formed in the frontwardly disposed bore of each cavity and provide normal retention of the contact while permitting its rearward release.

DETAILED DESCRIPTION

Figure 1:
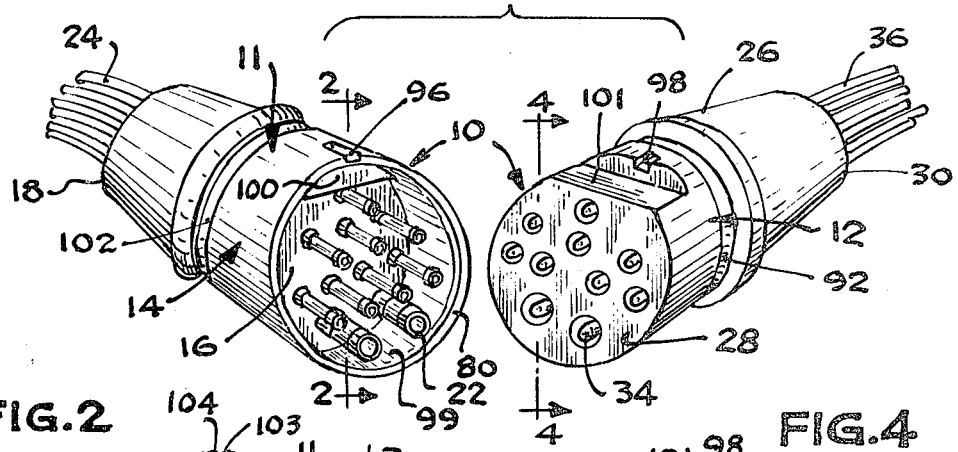
FIG. 1 is a perspective view of the receptacle and plug members of one embodiment of the invention.

In the connector assembly 10 illustrated in FIGS. 1–7, each of the connector members includes a one-piece molded housing of a resilient insulating material such as synthetic rubber. In receptacle 11 illustrated in FIGS. 1–3, housing 14 is provided with front and rear faces 16 and 18, respectively, and includes a plurality of cavities 20. Mounted in cavities 20 are a plurality of socket contacts 22 which, as illustrated, are crimped on rear conductors 24 which extend rearwardly from housing 14. In a similar manner, plug 12 includes insulating housing 26 with front and rear faces 28 and 30, respectively, and in which a plurality of cavities 32 are provided for pin contacts 34 connected to conductors 36.

Figure 2:
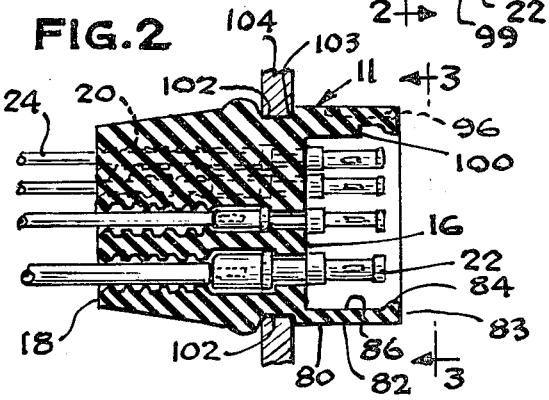
FIG. 2 is a side view in cross section of the receptacle member of FIG. 1 taken along line 2—2.
Figure 4:
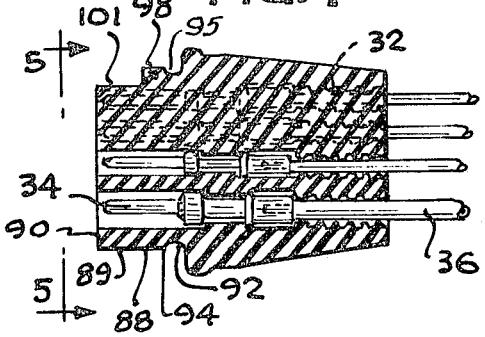
FIG. 4 is a side view in cross section of the plug member of FIG. 1 taken along line 4—4.
Figure 3:
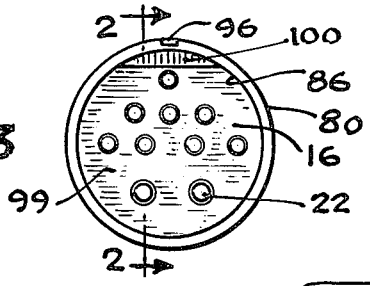
FIG. 3 is a front view of the receptacle member of FIG. 1.
Figure 5:
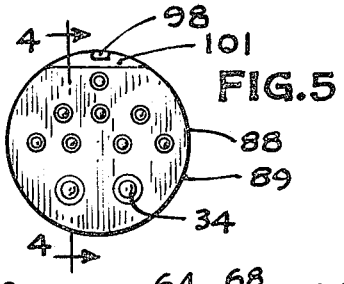
FIG. 5 is a front view of the plug member of FIG. 1.
Figure 6:
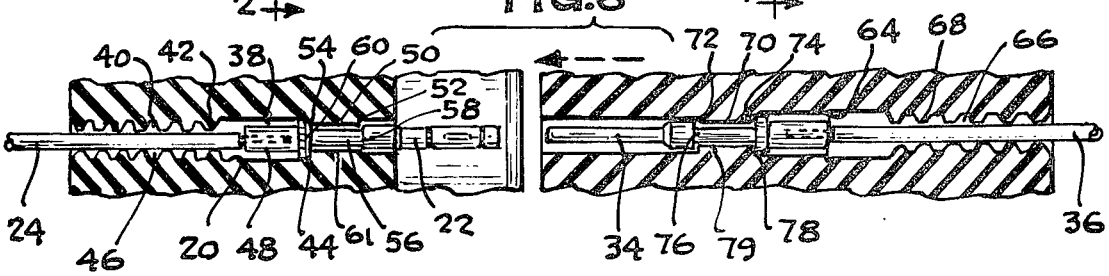
FIG. 6 is an expanded view of a partial cross section of the receptacle and plug members of FIGS. 2 and 4.
Figure 7:
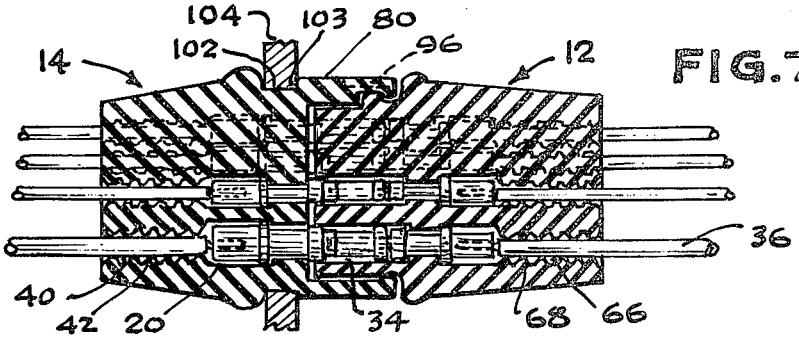
FIG. 7 is a view in cross section of the mated receptacle and plug members of FIGS. 2 and 4.

As illustrated in FIGS. 2, 4 and 6, the cavities of the receptacle and plug extend longitudinally between front and rear faces to respectively provide access for mating contacts and exit passage for rear conductors connected to the contacts. For receptacle 11, each cavity 20 includes bore 38 in close juxtaposition with front face 16 and rearwardly contiguous with bore 38 is a restricted passage 40 formed of one or more resilient risers 42. If more than one riser is used, they are spaced apart longitudinally along passage 40. As illustrated in FIG. 2, contacts 22 can be of different sizes and normally have a greater maximum diameter 44 than the diameter 46 of conductor 24. At least one or more risers 42 represent a portion in passage 40 formed to normally bear against insulated conductor 24 to provide the desired rear seal with sufficient resiliency to contract about conductor 24 rearwardly connected to contact 22 when mounted in bore 38 to thereby retain conductor 24 in a sealing relation to the insulating material of the housing. During forward installation and rearward removal of contact 22 and conductor 24, risers 42 are elastically expanded outwardly to permit passage of contact 22 in the desired direction.

Each of the contacts 22 in receptacle 11 is electrically connected to an insulated conductor 24. In the preferred embodiment, the connection is made by crimping conductor 24 in crimp barrel 48, after which the combination is inserted frontwardly into cavity 20 through rear face 18 by means of a suitable tool (not shown). As illustrated, contact 22 and bore 38 are shaped so that contact 22 resists removal from bore 38 by normal contact coupling and uncoupling forces developed during mating and unmating of receptacle 11 and plug 12, while permitting contact 22 to be rearwardly withdrawn when a larger force is utilized.

For retention of contact 22 in cavity 20, contact receiving bore 38 is formed with a restricted collar 50 as contact retention means providing front and rear abutment shoulders 52 and 54 which releasably bear against corresponding shoulders 58 and 60 in the mounting portion 56 of contact 22. Collar 50 is thereby shaped for cooperation with mounting means on contact 22. As illustrated, shoulders 58 and 60 form part of groove 61 and are shaped for mounting and retention of contact 22 in bore 38.

In a similar manner to the construction of cavities 20 and housing 14, cavities 32 of housing 26 include a frontwardly disposed bore 64 and a rearwardly disposed restricted passage 66 formed by risers 68, and contacts 32 are similarly shaped to contacts 22. Bore 64 is also provided with restricted collar 70 forming shoulders 72 and 74 for abutting engagement with shoulders 76 and 78 forming groove 79 of contact 34. With shoulders 76 and 78, contact 34 is shaped similar to contact 22 and acts in cooperation with collar 70 to prevent removal of the contact by normal forces attending the mating and unmating of the members 11 and 12.

As illustrated in FIGS. 1–3 and 7, the one-piece insulating housing 14 of receptacle 11 further includes an integrally molded, thin, cylindricially-shaped resilient sleeve 80 frontwardly extending beyond front face 16 for mating engagement with plug 12. Sleeve 80 is provided with a forward end portion 82 on which is formed an inwardly directed, elastically expandable sealing lip 84 disposed in juxtaposition with front end 83 of portion 82. For the desired sealing effect, sleeve 80 is inwardly round and lip 84 extends circumferentially around the inner perimeter 86 of sleeve 80.

For engagement with sleeve 80, plug 12 is provided with a forward end portion 88 having a cylindrically-shaped outer perimeter 89 for telescoping engagement within sleeve 80. As illustrated in FIGS. 1–4, 5 and 7, forward end portions 88 includes front end 90 with front face 28 and rearwardly spaced groove 92 providing a surface for sealing engagement with sleeve 80 and specifically with lip 84 when receptacle 11 and plug 12 are mated. Groove 92 is spaced and sized so that lip 84 tightly engages surface 94 and extends circumferentially around perimeter 89. Abutment shoulder 95 is formed by groove 92 and prevents accidental release of the mated members, providing a detent function by its engagement against lip 84.

By way of illustration and and not for limitation, receptacle 11 may be sized to provide a restricted passage 40 of about 0.060 inches diameter with each riser 42 being tapered outwardly at about 60° to a diameter of about 0.170 inches, and a bore 38 of about 0.155 inches diameter rearwardly of collar 50 which is about 0.225 inches long and about 0.065 inches diameter. Contact 22 is correspondingly sized with dimensions for diameter 44 being about 0.161 inches and for groove 61 being about 0.235 inches long and for mounting portion 56 at groove 61 being about 0.070 inches in diameter. Sleeve 80 includes lip 84 having a dimension of about 0.135 inches parallel to the axis of the sleeve and about 0.035 inches high with groove 92 being about 0.100 inches long.

In the assembly of the contacts in the connector members, the contacts are crimped or otherwise electrically connected to conductors after which the contacts are forcibly inserted through the restricted passages of the contact cavities, preferably by the use of a suitable tool (not shown) and secured against the contact-retaining abutment shoulders in the cavity bores. In this arrangement, the multiple resilient risers bear against the insulation of the conductors in a sealing relationship and provide the desired rear seal. When individual contacts require removal, a blunt tool (not shown) is used against the mating end of the contact and a rearwardly directed force is applied causing the contact to again radially expand the risers and be removed from the cavity.

After the contacts are assembled, the receptacle and plug are mated during which lip 84 of sleeve 80 elastically expands outwardly and rides over the outer perimeter 89 of forward end portion 88 until lip 84 reaches and snaps into groove 92 to provide the front seal. During the mating operation, contacts 22 and 34 are also mated providing electrical interconnection between conductors 24 and 36.

In order that contacts 22 engage contacts 34 in the desired arrangement, alignment means are provided on both housings 14 and 26 of the connector members. As illustrated in FIGS. 1–5 and 7, the alignment means include a longitudinal outer groove 96 on sleeve 80 and a similar groove 98 on perimeter 89 of forward end portion 88 for visual aid in alignment of receptacle 11 and plug 12 prior to mating. Groove 98 is frontwardly disposed from groove 92 and rearwardly disposed from front face 28. It provides means cooperating with the sleeve during a portion of the telescoping movement of the receptacle and plug members for permitting some air being drawn into the hollow interior 99 of sleeve 80 during separation from plug 12 after lip 84 has been disengaged from sealing groove 92. In a similar manner, groove 98 permits escape of some air during mating of the members. However, groove 98 is not operative as an air leak passage when the plug and receptacle are fully mated, and the effect of momentary disengaging forces on a mated connector is to create a vacuum in the space between the members, which helps to prevent accidental unmating.

A further feature of the connector involves polarizing means for physically assuring correct alignment receptacle 11 and plug 12 in the desired arrangement. In the receptacle, the polarizing means is formed within the sleeve 80 and complementary polarizing means is provided on the plug to assure properly polarized relation of the members during mating engagement. As illustrated, a block portion 100 is formed within sleeve 80, extending into the generally cylindrical cavity defined by the inner perimeter 86 of sleeve 80, but with its front end rearwardly spaced from front end 83. Portion 100 is shaped to enter and fit into cutaway portion 101 of forward end portion 88 of plug 12 and thus positively prevent mating of the members in other than a correct rotationally polarized relation.

In use, the connector assembly can be mounted in various structures. In the preferred embodiment, receptacle 11 is illustrated with rearwardly disposed groove 102 for mounting of the receptacle 11 in an opening 103 of a panel 104.

The foregoing description of the present invention is only illustrative of an exemplary form which the invention may take. Still other modifications and variations will suggest themselves to persons skilled in the art. It is intended, therefore, that the foregoing detailed description be considered as exemplary only and that the scope of the invention be ascertained from the following claims.

I claim:

1. A connector assembly comprising mating receptacle and plug members, each comprising a one-piece molded housing of insulating material with front and rear faces, a plurality of cavities longitudinally extending between said faces, each of said cavities including a bore in close juxtaposition with said front face and rearwardly contiguous therewith a restricted passage formed by at least one resilient riser, a plurality of rearwardly removable contacts respectively mounted in said bores, each of said contacts for connection to an insulated conductor and shaped to prevent removal by normal contact mating and unmating forces but permitting a larger force than said normal forces to cause rearward removal of said contact by radially expanding said riser, said riser normally retaining said conductor in a sealing relationship, said housing including front and rear abutment shoulders in said bore and said contact including shoulders, said housing shoulders releasably bearing against said contact shoulders, said housing of said receptacle member including a resilient sleeve integrally formed on said housing and frontwardly extending from said front face of said receptacle member, said sleeve including a forward end with an inwardly directed, elastically expandable lip extending circumferentially around said sleeve, and a polarizing shape inside said sleeve and rearwardly disposed from said lip, and said housing of said plug member including a forward end portion including said front face of said plug member and with a cylindrically-shaped outer perimeter for telescoping engagement within said sleeve, said perimeter including a circumferential sealing surface rearwardly spaced from said front face of said plug member for engagement with said sleeve when said receptacle and plug members are mated and a corresponding cutaway portion frontwardly disposed from said sealing surface to receive said polarizing shape.

2. The connector assembly of claim 1 wherein said shoulders on said contact are at opposite ends of a groove in said contact.

3. The connector assembly of claim 1 wherein said outer perimeter of said plug member includes means rearwardly disposed from said front face of said plug member and cooperating with said sleeve during a portion of the telescoping movement therebetween for permitting entry or escape of gas during respective mating or unmating of the receptacle and plug members.

4. The connector assembly of claim 1 wherein said receptacle and plug members include visual alignment means including a mark in said outer perimeter of said forward end portion of said plug member and frontwardly disposed from said circumferential sealing surface.

5. The connector assembly of claim 4 wherein one of said members includes means for mounting said assembly in a panel opening.

6. The connector assembly of claim 1 wherein said circumferential sealing surface comprises a groove around said forward end portion of said plug member.

7. The connector assembly of claim 6 wherein said groove is dimensioned to effect a sealing engagement with the lip portion of said sleeve when said plug member is fully engaged with said receptacle member.

8. A connector assembly including mating receptacle and plug members, each comprising a one-piece molded housing of insulating material with front and rear faces, a plurality of cavities longitudinally extending between said faces, each of said cavities having adjacent said rear face a restricted passage formed by at least one resilient riser, a plurality of rearwardly removable contacts respectively mounted in said cavities, each of said contacts adapted for connection to an insulated conductor, said riser normally engaging said conductor in a sealing relationship, said housing including front and rear resilient abutment shoulders in each said cavity and each said contact including shoulders, said housing shoulders releasably bearing against said contact shoulders, said housing of said receptacle member including a sleeve integrally formed on said housing and frontwardly extending from said front face of said receptacle member, said sleeve including a forward end with an elastically expandable lip extending circumferentially around said sleeve, said receptacle member having a polarizing portion inside said sleeve and rearwardly disposed from said lip, and the forward end of said housing of said plug member having an outer perimeter dimensioned for telescoping engagement within said sleeve, said perimeter including a circumferential sealing surface rearwardly spaced from said front face of said plug member for resilient engagement with said sleeve when said receptacle and plug members are mated, and a cutaway portion frontwardly disposed from said sealing surface and shaped to receive said polarizing portion.

* * * * *